US006041763A

United States Patent [19]

Akyildiz

[11] Patent Number: 6,041,763

[45] Date of Patent: Mar. 28, 2000

[54] FUEL LINE ENHANCER

[75] Inventor: Saban Akyildiz, White Plains, N.Y.

[73] Assignee: Magnificent Researchers C.M.L.S., Inc., White Plains, N.Y.

[21] Appl. No.: 08/842,676

[22] Filed: Apr. 15, 1997

Related U.S. Application Data

[60] Provisional application No. 60/023,238, Aug. 23, 1996, and provisional application No. 60/035,006, Jan. 8, 1997.

[51] Int. Cl.[7] ..... F02M 53/00

[52] U.S. Cl. ..... 123/538

[58] Field of Search ..... 123/536, 537, 123/538, 541

[56] References Cited

U.S. PATENT DOCUMENTS

| | | | |
|---|---|---|---|
| 3,349,354 | 10/1967 | Miyata | 123/536 |
| 4,036,182 | 7/1977 | Gandy | 123/41.31 |
| 4,155,337 | 5/1979 | Hensley . | |
| 4,461,262 | 7/1984 | Chow | 123/536 |
| 4,572,145 | 2/1986 | Mitchell et al. . | |
| 4,790,145 | 12/1988 | Thompson et al. . | |
| 4,808,306 | 2/1989 | Mitchell et al. . | |
| 4,898,141 | 2/1990 | Fiedler | 123/541 |
| 4,938,036 | 7/1990 | Hodgkins et al. . | |
| 5,048,498 | 9/1991 | Cardan | 123/538 |
| 5,076,246 | 12/1991 | Onyszczuk | 123/538 |
| 5,129,382 | 7/1992 | Stamps, Sr. et al. | 123/536 |
| 5,156,134 | 10/1992 | Tochizawa | 123/541 |
| 5,161,512 | 11/1992 | Adam et al. | 123/538 |
| 5,251,603 | 10/1993 | Watanabe et al. | 123/541 |
| 5,271,369 | 12/1993 | Melendrez | 123/538 |
| 5,331,807 | 7/1994 | Hricak . | |

*Primary Examiner*—Marguerite McMahon
*Attorney, Agent, or Firm*—Gottlieb, Rackman & Reisman, P.C.

[57] ABSTRACT

A device for pre-conditioning fuel before it enters either an internal combustion chamber or a furnace employs appropriate arrangements of magnets and a heat exchanger. The in-line fuel conditioning apparatus comprises a cylindrical fuel impervious container and a temperature control flow line that passes through the cylinder. While passing through the container the fuel contacts a magnetic field generated by a series of magnets (preferably and even number of pairs) arranged so that pole pieces having the same polarity (i.e. N or S) face each other, while adjacent pole pieces have opposite polarities. A gap separates the poles pieces of each pair and the fuel flows through this gap. Alternative embodiments are concerned with different configurations for bringing together the fuel, the magnets and the coolant during the transport of the fuel to the combustion region. For the pre-treatment of fuel for an internal combustion engine a source of coolant is used to lower the temperature of the fuel contacting the magnetic field generated by the magnets. For the pre-treatment of heating oil being delivered to a furnace a greater efficiency of burning occurs when a temperature control flow line, such as a copper hot water tube wrapped around the container, is used to raise, rather than lower the temperature of the fuel.

9 Claims, 4 Drawing Sheets

FUEL LINE ENHANCER

This application is derived from provisional application No. 60/023,238 filed Aug. 23, 1996 and No. 60/035,006 filed Jan. 8, 1997.

FIELD OF THE INVENTION

This invention relates to devices to enhance the fuel efficiency and reduce pollutants in liquid fuel lines. In particular it relates to a device that uses temperature control and magnetic field effects to enhance an in-line fuel line.

BACKGROUND OF THE INVENTION

The prior art has recognized that passing the fuel line of a vehicle through a magnetic field can enhance its efficiency. Similarly it is known that the cooling of gasoline before entering a carburetor can reduce the occurrence of vapor lock, a condition caused when gasoline vapor fills a narrow tube and prevents the flow of the liquid gas prior to its mixture with air in the carburetor. The exact mechanism by which magnetic conditioning produces changes in fluids is not fully understood. U.S. patents such as U.S. Pat. Nos. 5,161,512 and 5,271,369 have suggested various often conflicting rationales. One explanation is that magnetic conditioning created by a magnetic flux about the fluid passageway charges all the molecules of the fluid negatively so that the molecules tend to more quickly and evenly disperse in the combustion chamber, improving combustion characteristics. This results in more power and a reduction in emission of unburnt fuel. See U.S. Pat. No. 5,129,382. Another explanation for increased fuel economy resulting from the use of magnets mounted on the inlets before the mixing zone of combustion devices is that the magnets increase the density of the fuel and thus promote more efficient combustion. See U.S. Pat. No. 4,461,262. A third explanation presented for the increase in engine performance is that the magnetic field partially ionizes fuel flowing in the fuel line to increase the fuel's affinity for oxygen, thus providing for more complete combustion of fuel in the cylinders of the engine. See U.S. Pat. No. 5,271,639.

None of these prior art descriptions combine magnetism with cooling effects and none report the dramatic reduction in emissions that have been achieved with the present invention. Also none have utilized the particular arrangement of magnetic fields of the present invention.

Some effects of cooling of fuel have been noted. Increased fuel temperature is known to cause vaporization in the fuel tank. Some of this vaporized fuel is absorbed by a fuel canister, which contains activated carbon to prevent leakage of fuel vapor to the outside. When the temperature of the fuel is elevated in modern cars by the many hot elements present under the hood more vapor is released than can be absorbed. Reduction of fuel temperature offsets this effect as well as preventing vapor lock. See U.S. Pat. No. 5,251,603 concerning vapor lock. Again, none of these disclosures report the remarkable reduction of emissions achieved by the combined technologies of the present invention.

BRIEF DESCRIPTION OF THE INVENTION

The invention provides pre-conditioning of fuel before it enters either an internal combustion chamber or a furnace. It provides in one embodiment an in-line fuel conditioning apparatus for the fuel line of a conventional automobile, utilizing appropriate arrangements of magnets and the automobile's air conditioning compressor for its source of coolant.

The in-line fuel conditioning apparatus comprises a cylindrical fuel impervious container and a temperature control flow line that passes through the cylinder. While passing through the container the fuel contacts a magnetic field generated by a series of magnets (preferably an even number of pairs) arranged so that pole pieces having the same polarity (i.e. N or S) face each other, while adjacent pole pieces have opposite polarities. A gap separates the poles pieces of each pair and the fuel flows through this gap.

Alternative embodiments are concerned with different configurations for bringing together the fuel, the magnets and the coolant during the transport of the fuel to the combustion region.

A very different embodiment concerns the pre-treatment of heating oil being delivered to a furnace or diesel fuel for an internal combustion engine. A remarkably unexpected result is observed that a greater efficiency of combustion occurs in these cases when a temperature control flow line is used to raise, rather than lower the temperature of the fuel. In a home heating situation, a copper hot water tube is wrapped around the container to provide the heat source. In a diesel engine the hot end of the coolant line from an air conditioning compressor is used to heat the fuel.

DETAILED DESCRIPTION OF PREFERRED EMBODIMENTS

The present invention is an apparatus for pre-conditioning fuel before it enters a combustion chamber. The invention has application to internal combustion engines igniting mixtures of air and gasoline or diesel fuel as well as furnaces that burn mixtures of air and dispersed heating oil. Other fuels, such as hydrocarbons and peroxides are also expected to benefit from the use of devices constructed in accord with the utilization of thermal controlling structures and magnetic fields as disclosed below. The preferred embodiment of the invention will be described in connection with an automobile internal combustion engine in which gasoline is delivered through a fuel line from a fuel pump to a fuel injection system after premixing the fuel with air.

The in-line fuel conditioning apparatus of the present invention is intended to be located in the fuel line of a conventional automobile. It's exact location in the fuel line is not a critical element of the invention and is mainly a matter of convenience in locating the apparatus and making necessary connections to the cooling line that serves the automobile air-conditioning system.

Figure 1:
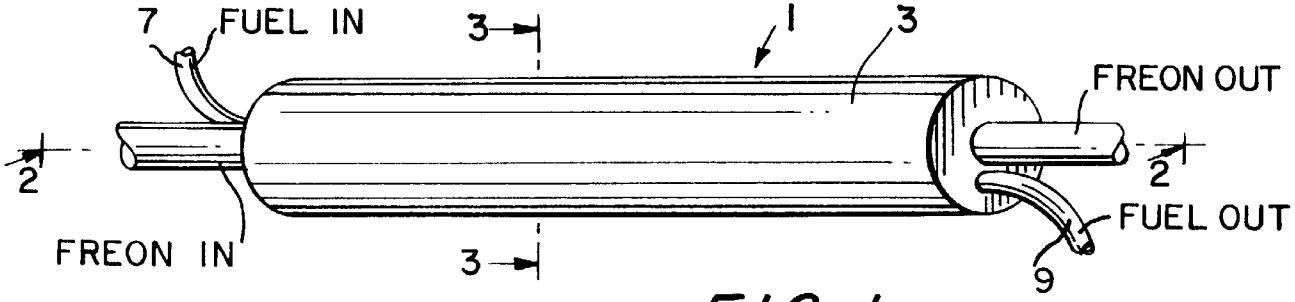
FIG. 1 is a perspective view of a preferred embodiment of the invention.

As shown in FIG. 1, the preferred in-line fuel conditioning apparatus 1 comprises an approximately 8" long, 2½" diameter, cylindrical fuel impervious container 3 made from aluminum or other non-ferrous metal. This configuration provides superior cooling to a configuration that is 8" long and 1½" diameter. Although less preferred, this configuration is also feasible. A temperature control flow line 5 passes through the cylinder and is sealed to the end walls so that a closed volume space interior to the walls of cylindrical container can hold the fuel without leaking. The purpose of this temperature control flow line 5 is to exchange heat with the fuel present in the container and thereby to cool it. Normally the temperature control flow line contains a Freon or other coolant that also passes through the heat exchange elements of the automobile air conditioning system. This enables the invention to operate without the need to provide additional supplemental cooling equipment, although it is not outside the scope of the present invention to provide such additional equipment. A control valve may be placed in the coolant line to control the amount of coolant diverted to the fuel conditioning apparatus in order to control the extent of cooling and thereby avoid freezing water that may be present in the fuel that would block the flow of fuel. The fuel enters and leaves the container 3 through input port 7 and outlet port 9, respectively. These ports may be tubular extensions welded through the end plates of the cylindrical container.

Figure 3:
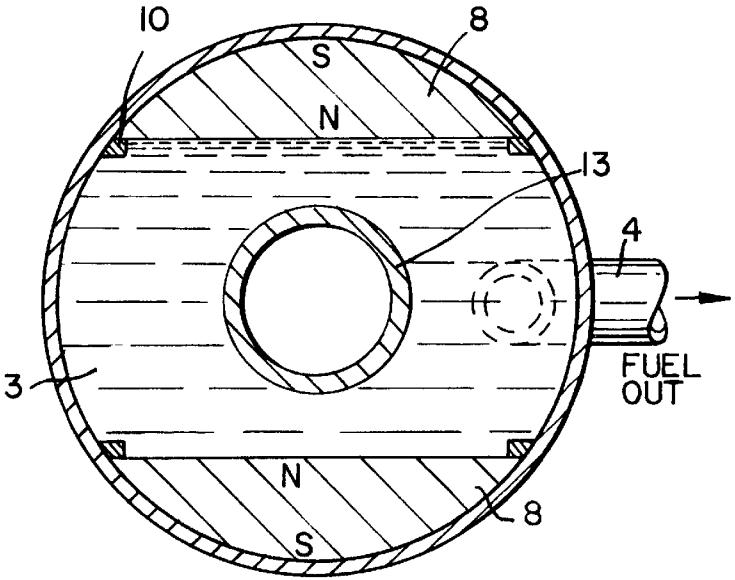
FIG. 3 is a transverse cross section view of the embodiment of FIG. 1.
Figure 4:
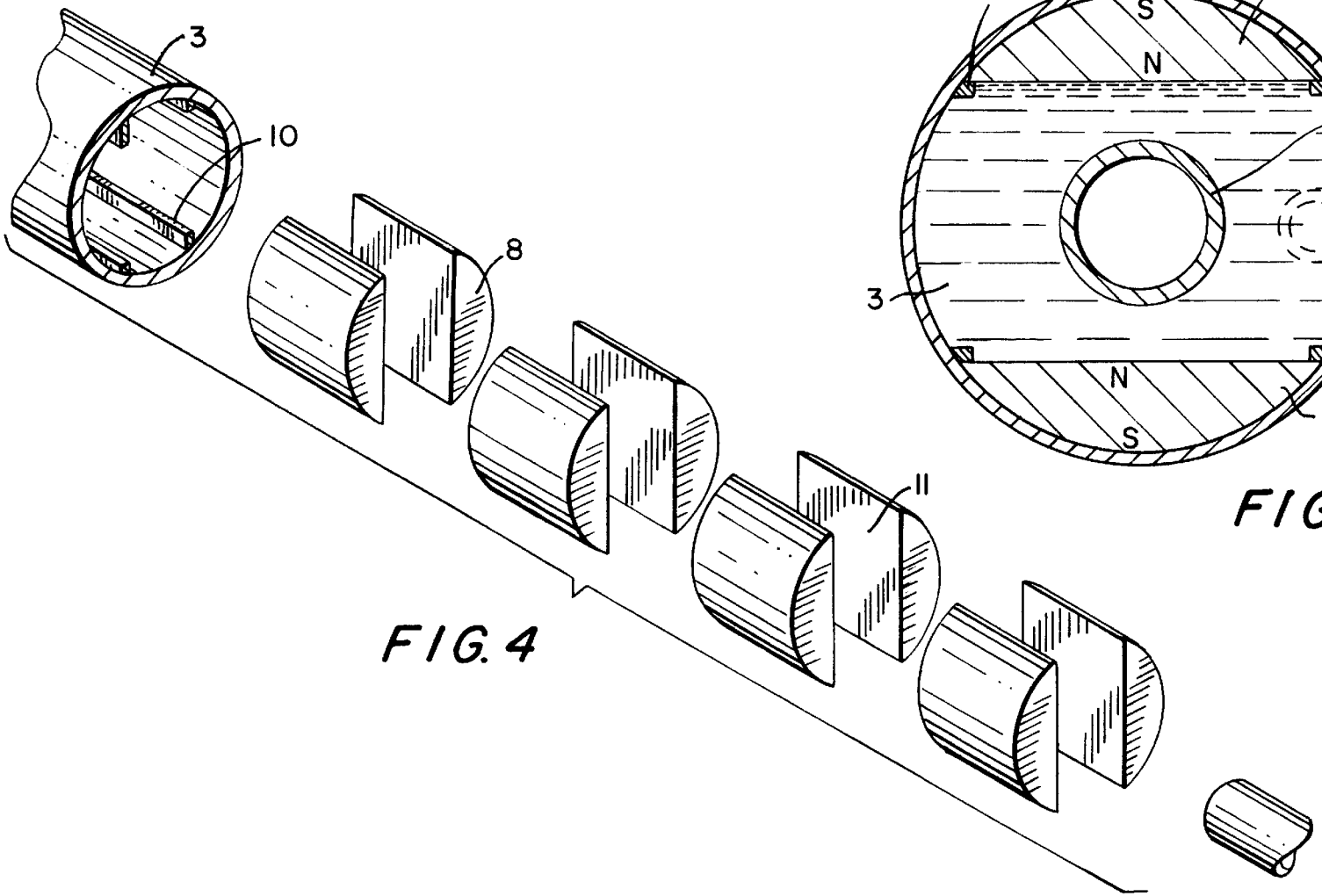
FIG. 4 is an exploded view of the embodiment of FIG. 1 showing the magnets internal to the embodiment.

The fuel passes through the container driven by the pressure from the automobile fuel pump. While passing through the container 3 the fuel contacts a magnetic field generated by a series of magnets 8. The orientation and location of the magnets is best understood by examination of FIGS. 2–4. FIG. 4 shows an exploded view of four pairs of magnets. As shown, the magnets are arranged so that pole pieces having the same polarity (i.e. N or S) face each other, while adjacent pole pieces have opposite polarities. A gap 11 of approximately 1 mm to 6.5 mm separates the poles pieces of each pair and the fuel flows through this gap. Preferably this gap is reduced to increase the magnetic field strength. A preferred value is less than 2 mm. Values as small as 0.06 mm are acceptable. The Freon flow line 13 also passes between the pole pieces in this embodiment, although the location of that line between the pole pieces is not a critical element of the invention.

Figure 2:
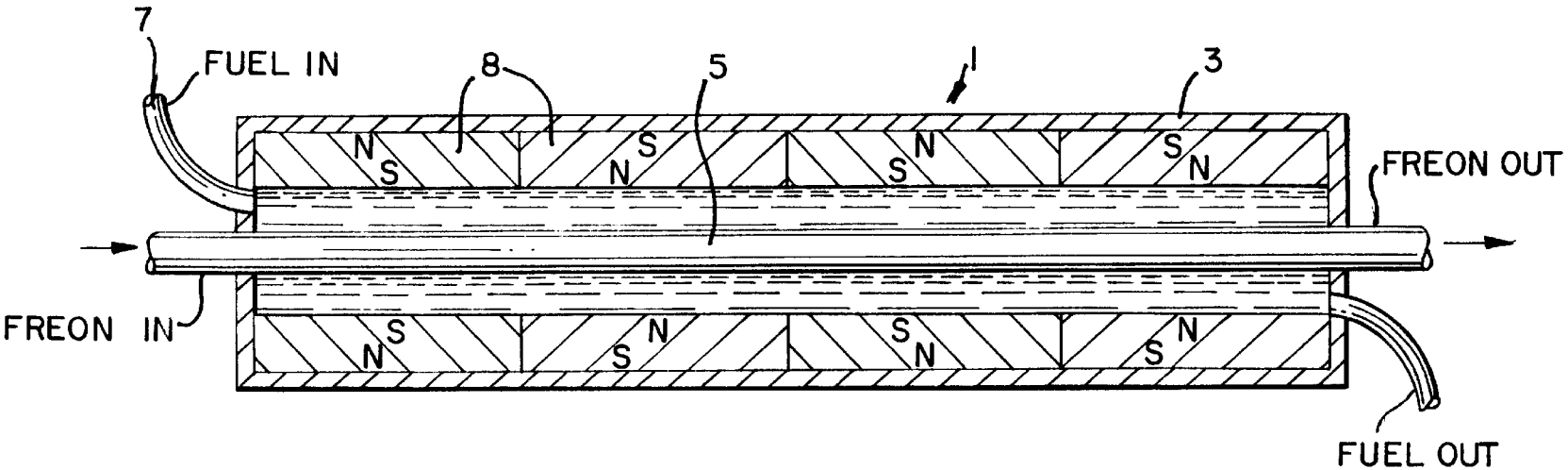
FIG. 2 is a longitudinal cross section of the embodiment of FIG. 1.

As best shown in FIG. 2, the magnets 8 are arranged in pairs that abut, with alternating polarities from pair to pair. Thus each pair of magnets has either S poles facing each other across the gap, or N poles facing each other across the gap, while at the same time the S pole of one pair abuts a N pole of the adjacent pair. The magnets are held in place by supporting ribs 10 located along the axial length of the interior surface of the container.

The preferred embodiment of the invention has been described in connection with permanent magnets. These are preferably arranged so that they provide a field strength conventionally provided by Alnico magnets of the dimensions that may be included within the disclosed container. As far as known to the inventor, the system's performance is enhanced by the use of stronger magnets. Permanent magnets such as Alnico (Aluminum, Nickel, Cobalt alloy) may be used, as they are both relatively strong and economical. Electromagnets are conceivable, although one would not wish to introduce current carrying leads into the fuel line because of the possibility of fire hazard. It might be acceptable to extend a portion of the magnetically susceptible material of an electromagnet exterior to the container, weld it into place and then attach coils to the part remote from the wall of the cylinder.

In operation, fuel is driven by pressure through the container where it gives up its heat to the coolant and passes through magnetic fields that alternate in direction as it passes down the length of the apparatus. The resulting change in properties of the fuel is dramatic. The quantity of hydrocarbon pollutants in the exhaust from the engine becomes undetectable in standard automotive pollution testing equipment. Indeed, the exhaust loses its characteristic hydrocarbon odor. Fuel efficiency increases. The engine not only performs better, but such problems as vapor fuel lock diminish.

EXAMPLE

An apparatus as described in the first preferred embodiment was installed in a 1994 Camero V6 with fuel injection. The device was located in the fuel line between the fuel pump and the fuel injectors. Emission readings prior to and subsequent to installation (time=0) of the invention showed the following values, indicating the virtual elimination of measurable hydrocarbons and carbon monoxide from the exhaust:

| Time (minutes) | Hydrocarbons (ppm) | Carbon Dioxide (%) | Carbon Monoxide (%) | Oxygen (%) |
|---|---|---|---|---|
| 0 | 268 | 14.1 | 2.25 | 0.7 |
| 2 | 176 | 14.7 | 1.79 | 0.3 |
| 12 | 104 | 15.4 | 0.31 | 0.9 |
| 14 | 5 | 16.2 | 0.01 | 0.3 |
| 16 | 0 | 16.3 | 0.01 | 0.2 |
| 17 | 1 | 16.1 | 0.01 | 0.3 |
| 20 | 0 | 16.3 | 0.01 | 0.1 |

The results of the above table contrast strongly with the results obtained when either the magnetic field is removed or the cooling line is removed. In either case the reduction in Carbon Monoxide emissions is only 6% to 15% of the reduction achieved by the combination of both magnetism and cooling.

The physical reason for the transformation in exhaust properties, although not necessarily part of the patent description are only guessed at by the inventor. The cooling of the fuel may serve to preserve some of the effect of the magnetic field upon the gasoline simply by reducing the thermal agitation in the gasoline. Confidence in this explanation, however, is questioned since it is heating rather than cooling that best benefits the use of the invention in connection with the combustion of heating fuels. The magnetic field has its effect upon the gasoline either because of the presence of magnetically susceptible particles in the gas, or the presence of electric charge on particles of the gas. This electric charge may be atomic charges associated with the chemical composition of the gasoline molecules (or its additives or impurities) or due to the ionization of gas molecules. In any event, it is the combination of both temperature and magnetic phenomena that through trial and error has been seen to result in the enhanced properties of the fuel that has passed through the container of the invention.

Figure 5:
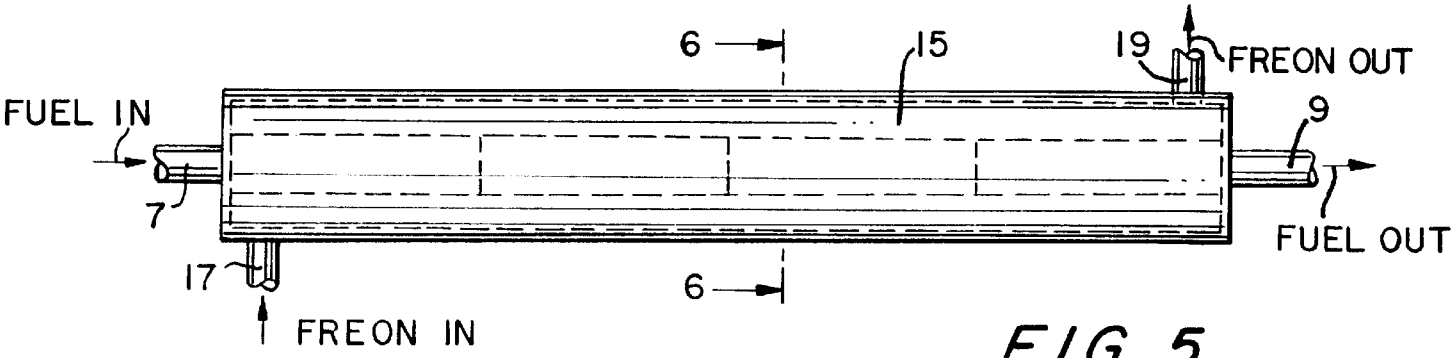
FIG. 5 is a perspective view of an alternative embodiment of the preferred embodiment.
Figure 6:
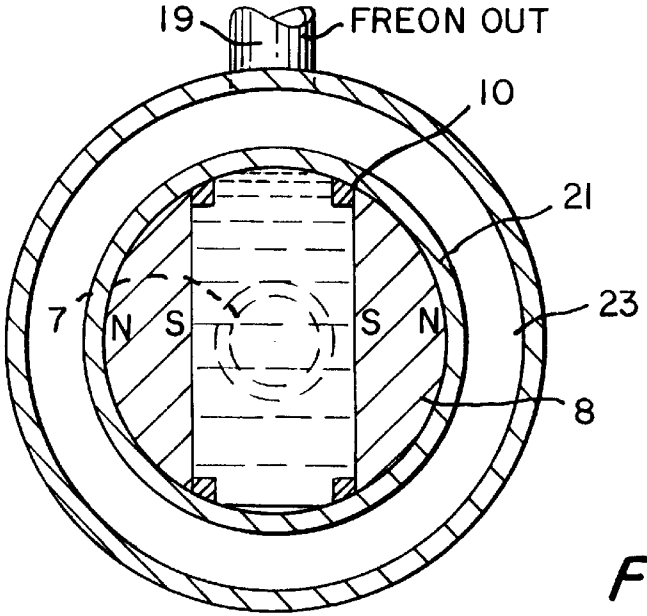
FIG. 6 is a transverse cross section view of the embodiment of FIG. 5.

FIGS. 5 and 6 depict an alternative embodiment for the invention. Here there is a container 15, which is impervious to the coolant entering via the temperature control inlet port 17 and exiting through the temperature control outlet port 19. This alternative preferred embodiment contrasts with the previously described preferred embodiment by passing the fuel through the fuel flow line 21 that is centrally located in the container 15, while surrounded by the coolant in the surrounding coolant cavity 23. The magnets 8 are internal to the fuel flow line 21 in a configuration like that of FIG. 3, i.e. with opposing equal magnetic poles and adjacent alternating magnetic poles. In this case the supporting ribs 10 for the magnets 8 are located on the inner wall of the fuel flow line 21 rather than the internal wall of the container. In a still further embodiment, not shown, the apparatus of FIGS. 1–4 may be utilized by utilizing the central temperature control flow line 5 to transport the fuel instead of coolant, and use the remained of the space within the container to transport the coolant. This is accomplished simply by interchanging the roll of the fuel and coolant input ports and also interchanging the roll of the fuel and coolant output ports.

Figure 7:
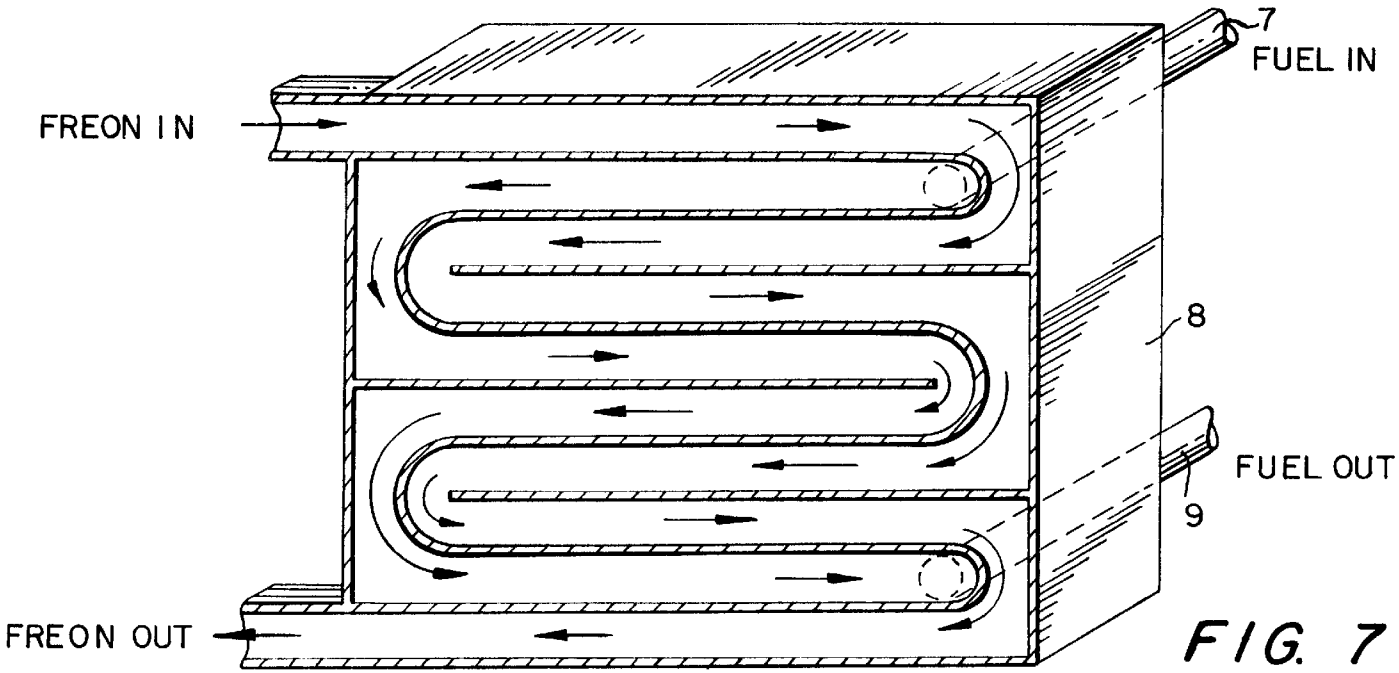
FIG. 7 is a transverse cross section view of a heat exchange embodiment of the present invention.

FIG. 7 depicts an alternative embodiment in which coolant and fuel lines are kept separate in a heat exchange relationship. The two separate flow lines for the respective fluids exchange heat through thin metallic walls shown in FIG. 7. The magnets are provided in the fuel in line and/or the fuel out line outside the region of the heat exchanger 8. The arrangement of the magnets in these fuel lines may be as shown in FIG. 4.

Figure 8:
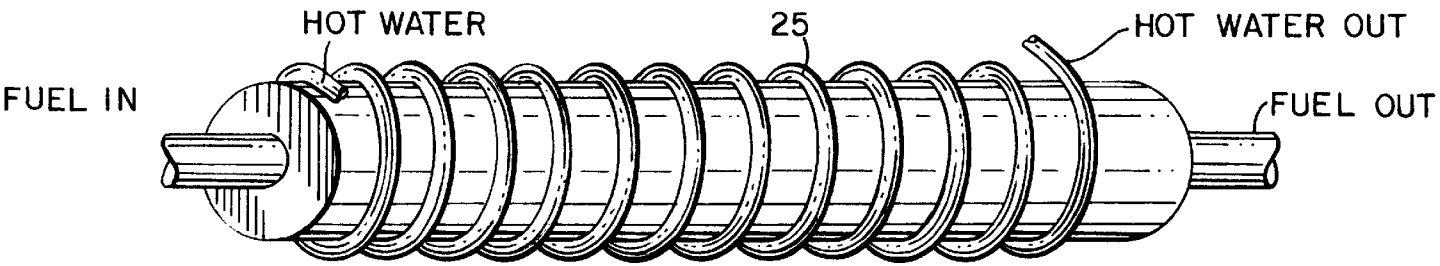
FIG. 8 is an alternative embodiment employing an external liquid coil to conduct heat through an external surface.

FIG. 8 depicts an embodiment to be used in conjunction with heating oil being delivered to a furnace. A remarkably unexpected result is observed that a container configured like that of FIG. 6 produces a greater efficiency of burning when a temperature control flow line is used to raise, rather than lower the temperature of the fuel. This result was entirely unexpected in view of the dramatic effect of lowering temperature observed with fuel lines for gasoline internal combustion engines. As depicted in FIG. 8, which is envisioned as a system useful in a home heating situation, a copper hot water tube 25 may be wrapped around the container to provide the necessary and convenient heat source.

Although the invention has been described in terms of specific embodiments, it is intended that the patent cover equivalent substitutions for any of the elements of these embodiments, and that the protection afforded by this patent be determined by the legitimate scope of the following claims:

What is claimed is:

1. An in-line fuel conditioning apparatus comprising a fuel impervious container having a fuel inlet port and a fuel outlet port, wherein fuel under pressure is passed through said container, a temperature control flow line in contact with said fuel, said flow line adapted to contain a temperature control fluid for controlling the temperature of the fuel, a plurality of magnets creating a magnetic field extending through said fuel, said plurality of magnets comprising a plurality of pairs of magnets, each pair having either south poles facing each other across a gap, or north poles facing each other across a gap, and arranged so that said fuel passes through said gap, wherein said plurality of pairs of magnets are arranged in a series of alternating polarity, wherein the south pole of each magnet abuts a north pole of adjacent magnets, and the north pole of each magnet abuts a south pole of adjacent magnets.

2. The in-line fuel conditioning apparatus of claim 1 wherein an even number of pairs of magnets are contained within said fuel impervious container.

3. An in-line fuel conditioning apparatus for an automobile having an internal combustion engine comprising a fuel impervious container having a fuel inlet port receiving fuel from a fuel pump and a fuel outlet port delivering fuel to one or more fuel injectors, wherein fuel under pressure from said fuel pump is passed through said container, a flow line in contact with said fuel, said flow line adapted to contain a temperature control fluid for controlling the temperature of the fuel, a plurality of pairs of magnets contained within said fuel impervious container creating a magnetic field extending through said fuel, each pair of magnets having either south poles facing each other across a gap, or north poles facing each other across a gap, and arranged so that said fuel passes through said gap, wherein said plurality of pairs of magnets are arranged in a series of alternating polarity, wherein the south pole of each magnet abuts a north pole of adjacent magnets, and the north pole of each magnet abuts a south pole of adjacent magnets.

4. The in-line fuel conditioning apparatus of claim 3, wherein said gap is less than 2 mm.

5. The in-line fuel conditioning apparatus of claim 3, wherein said magnets have at least the strength of Alnico magnets dimensioned to fit within said container.

6. An in-line fuel conditioning apparatus comprising a fuel impervious container having a fuel inlet port and a fuel outlet port, wherein fuel under pressure is passed through said container, a temperature control flow line in contact with said fuel, said flow line adapted to contain a temperature control fluid for controlling the temperature of the fuel, a plurality of magnets creating a magnetic field extending through said fuel, wherein said plurality of magnets comprises a plurality of pairs of magnets, each pair having either south poles facing each other across a gap, or north poles facing each other across a gap, and arranged so that said fuel line is located in said gap, wherein said plurality of pairs of magnets are arranged in a series of alternating polarity, and wherein the south pole of each magnet abuts a north pole of adjacent magnets, and the north pole of each magnet abuts a south pole of adjacent magnets.

7. The in-line fuel conditioning apparatus of claim 6, wherein said magnets are contained within said coolant impervious container.

8. An in-line fuel conditioning apparatus for an automobile having an internal combustion engine comprising a fuel and coolant impervious heat exchange container having a fuel inlet port receiving fuel from a fuel pump and a fuel outlet port delivering fuel to one or more fuel injectors, wherein fuel under pressure from said fuel pump is passed through said container, a coolant inlet port receiving coolant from a compressor and a coolant outlet port for returning coolant to said compressor, said ports arranged to flow said fuel and coolant in separate channels to enable heat exchange between the fuel and the coolant, a plurality of pairs of magnets contained within said fuel and fluid impervious container creating a magnetic field extending through said fuel, each pair of magnets having either south poles facing each other across a gap, or north poles facing each other across a gap, and arranged so that said fuel passes through said gap, wherein said plurality of pairs of magnets are arranged in a series of alternating polarity, wherein the south pole of each magnet abuts a north pole of adjacent magnets, and the north pole of each magnet abuts a south pole of adjacent magnets.

9. An in-line fuel conditioning apparatus comprising a fuel impervious container having a fuel inlet port and a fuel outlet port, wherein fuel is passed through said container, a temperature control coil surrounding and in contact with said container, said coil adapted to contain a temperature control fluid for controlling the temperature of the fuel, a plurality of pairs of magnets contained within said fuel impervious container creating a magnetic field extending through said fuel, each pair of magnets having either south poles facing each other across a gap, or north poles facing each other across a gap, and arranged so that said fuel passes through said gap, wherein said plurality of pairs of magnets are arranged in a series of alternating polarity, wherein the south pole of each magnet abuts a north pole of adjacent magnets, and the north pole of each magnet abuts a south pole of adjacent magnets.

* * * * *